US010271157B2

(12) United States Patent
Jeon et al.

(10) Patent No.: US 10,271,157 B2
(45) Date of Patent: Apr. 23, 2019

(54) METHOD AND APPARATUS FOR PROCESSING AUDIO SIGNAL

(71) Applicant: Gaudio Lab, Inc., Los Angeles, CA (US)

(72) Inventors: Sewoon Jeon, Daejeon (KR); Jeonghun Seo, Seoul (KR); Hyunoh Oh, Seongnam-si (KR); Taegyu Lee, Seoul (KR); Yonghyun Baek, Seoul (KR)

(73) Assignee: Gaudio Lab, Inc., Los Angeles, CA (US)

( * ) Notice: Subject to any disclaimer, the term of this patent is extended or adjusted under 35 U.S.C. 154(b) by 0 days.

(21) Appl. No.: 15/608,969

(22) Filed: May 30, 2017

(65) Prior Publication Data

US 2017/0347218 A1 Nov. 30, 2017

(30) Foreign Application Priority Data

May 31, 2016 (KR) ..... 10-2016-0067792
May 31, 2016 (KR) ..... 10-2016-0067810

(51) Int. Cl.
*H04S 3/00* (2006.01)
*H04S 7/00* (2006.01)

(52) U.S. Cl.
CPC ..... *H04S 7/303* (2013.01); *H04S 3/008* (2013.01); *H04S 7/304* (2013.01); *H04S 2400/01* (2013.01); *H04S 2400/11* (2013.01); *H04S 2420/11* (2013.01)

(58) Field of Classification Search
None
See application file for complete search history.

(56) References Cited

U.S. PATENT DOCUMENTS

2009/0316913 A1* 12/2009 McGrath ..... H04S 3/02 381/20
2014/0358567 A1 12/2014 Koppens et al.
2017/0295446 A1* 10/2017 Thagadur Shivappa ..... H04S 7/304

FOREIGN PATENT DOCUMENTS

KR 10-2011-0130623 A 12/2011
KR 10-2012-0137253 A 12/2012
KR 10-1516644 B1 5/2015
(Continued)

OTHER PUBLICATIONS

English Translatin of KR 10-1516644 B1.*
(Continued)

*Primary Examiner* — James K Mooney
(74) *Attorney, Agent, or Firm* — Park, Kim & Suh, LLC

(57) ABSTRACT

Disclosed is an audio signal processing device. The audio signal processing device includes a receiving unit configured to receive a first audio signal corresponding to a sound collected by a first sound collecting device and a second audio signal corresponding to a sound collected by a second sound collecting device, a processor configured to process the second audio signal based on a correlation between the first audio signal and the second audio signal, and an output unit configured to output a processed second audio signal. The first audio signal is a signal for reproducing an output sound of a specific sound object, and the second audio signal is a signal for ambience reproduction of a space in which the specific sound object is positioned.

18 Claims, 8 Drawing Sheets

(56) References Cited

FOREIGN PATENT DOCUMENTS

KR 10-2016-0053910 A 5/2016

OTHER PUBLICATIONS

International Search Report and Written Opinion of the International Searching Authority dated Aug. 30, 2017 for Application No. PCT/KR2017/005610 with English translation.

* cited by examiner

METHOD AND APPARATUS FOR PROCESSING AUDIO SIGNAL

CROSS-REFERENCE TO RELATED APPLICATION

This application claims priority to Korean Patent Applications Nos. 10-2016-0067792 and 10-2016-0067810 filed on May 31, 2016, and all the benefits accruing therefrom under 35 U.S.C. § 119, the contents of which are incorporated by reference in their entirety.

BACKGROUND

The present invention relates to an audio signal processing method and device. More specifically, the present invention relates to an audio signal processing method and device for processing an audio signal expressible as an ambisonic signal.

3D audio commonly refers to a series of signal processing, transmission, encoding, and playback techniques for providing a sound which gives a sense of presence in a three-dimensional space by providing an additional axis corresponding to a height direction to a sound scene on a horizontal plane (2D) provided by conventional surround audio. In particular, 3D audio requires a rendering technique for forming a sound image at a virtual position where a speaker does not exist even if a larger number of speakers or a smaller number of speakers than that for a conventional technique are used.

3D audio is expected to become an audio solution to an ultra high definition TV (UHDTV), and is expected to be applied to various fields of theater sound, personal 3D TV, tablet, wireless communication terminal, and cloud game in addition to sound in a vehicle evolving into a high-quality infotainment space.

Meanwhile, a sound source provided to the 3D audio may include a channel-based signal and an object-based signal. Furthermore, the sound source may be a mixture type of the channel-based signal and the object-based signal, and, through this configuration, a new type of listening experience may be provided to a user.

An ambisonic signal may be used to provide a scene-based immersive sound. In particular, an higher order ambisonics (HoA) signal may be used to give a vivid sense of presence. In the case where the HoA signal is used, a sound acquisition procedure is simplified. Furthermore, in the case where the HoA signal is used, an audio scene of an entire three-dimensional space may be efficiently reproduced. Accordingly, an HoA signal processing technology may be useful for virtual reality (VR) for which a sound that gives a sense of presence is important. However, according to the HoA signal processing technology, it is difficult to accurately represent a location of an individual sound object within an audio scene.

SUMMARY

Embodiments of the present invention provide an audio signal processing method and device for processing a plurality of audio signals.

More specifically, embodiments of the present invention provide an audio signal processing method and device for processing an audio signal expressible as an ambisonic signal.

In accordance with an exemplary embodiment of the present invention, an audio signal processing device includes: a receiving unit configured to receive a first audio signal corresponding to a sound collected by a first sound collecting device and a second audio signal corresponding to a sound collected by a second sound collecting device; a processor configured to process the second audio signal based on a correlation between the first audio signal and the second audio signal; and an output unit configured to output a processed second audio signal. Here, the first audio signal is a signal for reproducing an output sound of a specific sound object, and the second audio signal is a signal for ambience reproduction of a space in which the specific sound object is positioned.

The processor may subtract an audio signal generated based on the first audio signal from the second audio signal.

The audio signal generated based on the first audio signal may be generated based on an audio signal obtained by applying a time delay to the first audio signal.

The audio signal generated based on the first audio signal may be obtained by delaying the first audio signal by as much as a time difference between the first audio signal and the second audio signal.

The audio signal generated based on the first audio signal may be obtained by scaling, based on a level difference between the first audio signal and the second audio signal, the audio signal obtained by applying the time delay to the first audio signal.

The processor may process the first audio signal by subtracting an audio signal generated based on the second audio signal from the first audio signal. Here, the output unit may output a processed first audio signal and the processed second audio signal.

The processor may obtain a parameter related to a location of the specific sound object based on the correlation between the first audio signal and the second audio signal. Here, the processor may render the first audio signal by localizing the specific sound object in a three-dimensional space based on the parameter related to the location of the specific sound object.

The processor may obtain the parameter related to the location of the specific sound object based on the correlation between the first audio signal and the second audio signal and a time difference between the first audio signal and the second audio signal.

The processor may obtain the parameter related to the location of the specific sound object based on the correlation between the first audio signal and the second audio signal, the time difference between the first audio signal and the second audio signal, and a variable constant for distance applied for each coordinate axis. Here, the variable constant for distance may be determined based on a directivity characteristic of a sound output from the specific sound object.

Furthermore, the variable constant for distance may be determined based on a radiation characteristic of the second sound collecting device.

Furthermore, the variable constant for distance may be determined based on a physical characteristic of a space in which the second sound collecting device is positioned.

The processor may determine a location in which the specific sound object is to be localized in the three-dimensional space according to a user's input, and may adjust the parameter related to the location of the specific sound object according to a determined location.

The processor may output the first audio signal in an object signal format and outputs the second audio signal in an ambisonic signal format, by using the output unit.

The processor may output the first audio signal in an ambisonic signal format and may output the second audio signal in the ambisonic signal format based on the parameter related to the location of the specific sound object, by using the output unit.

The processor may enhance a portion of components of the second audio signal based on the correlation between the first audio signal and the second audio signal.

In accordance with another exemplary embodiment of the present invention, a method for operating an audio signal processing device includes: receiving a first audio signal corresponding to a sound collected by a first sound collecting device and a second audio signal corresponding to a sound collected by a second sound collecting device; processing the second audio signal based on a correlation between the first audio signal and the second audio signal; and outputting a processed second audio signal. Here, the first audio signal is a signal for reproducing an output sound of a specific sound object, and the second audio signal is a signal for ambience reproduction of a space in which the specific sound object is positioned.

The processing the second audio signal may include subtracting an audio signal generated based on the first audio signal from the second audio signal.

The audio signal generated based on the first audio signal may be generated based on an audio signal obtained by applying a time delay to the first audio signal.

The audio signal generated based on the first audio signal may be obtained by delaying the first audio signal by as much as a time difference between the first audio signal and the second audio signal.

The audio signal generated based on the first audio signal may be obtained by scaling, based on a level difference between the first audio signal and the second audio signal, the audio signal obtained by applying the time delay to the first audio signal.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Figure 1:
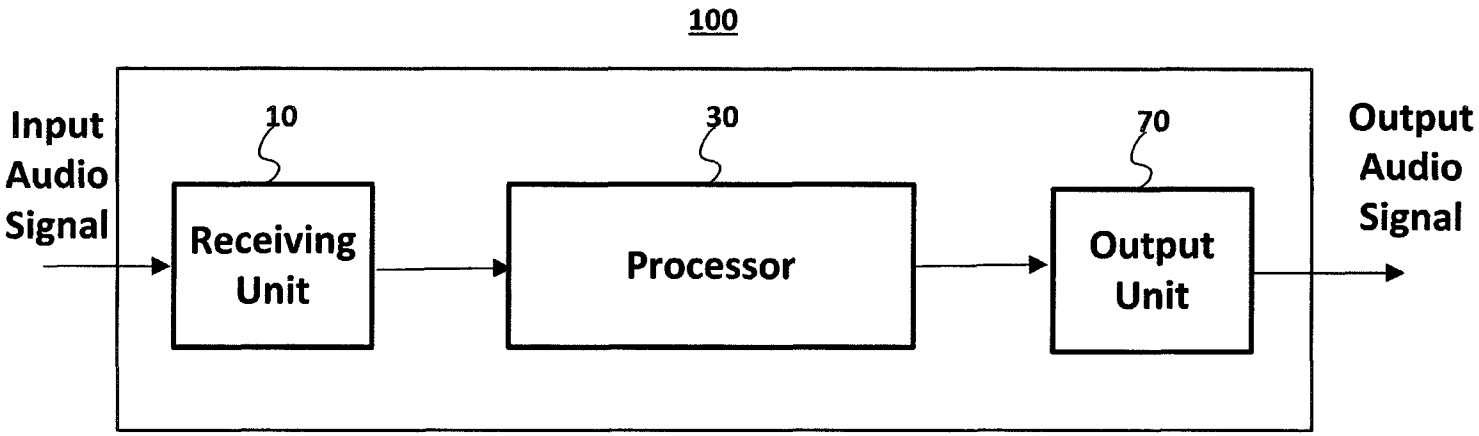
FIG. 1 is a block diagram illustrating an audio signal processing device according to an embodiment of the present invention.

Hereinafter, embodiments of the present invention will be described in detail with reference to the accompanying drawings so that the embodiments of the present invention can be easily carried out by those skilled in the art. However, the present invention may be implemented in various different forms and is not limited to the embodiments described herein. Some parts of the embodiments, which are not related to the description, are not illustrated in the drawings in order to clearly describe the embodiments of the present invention. Like reference numerals refer to like elements throughout the description.

When it is mentioned that a certain part "includes" certain elements, the part may further include other elements, unless otherwise specified.

FIG. 1 is a block diagram illustrating an audio signal processing device according to an embodiment of the present invention.

The audio signal processing device according to an embodiment of the present invention includes a receiving unit 10, a processor 30, and an output unit 70.

The receiving unit 10 receives an input audio signal. Here, the input audio signal may be a signal obtained by converting a sound collected by a sound collecting device. The sound collecting device may be a microphone. The sound collecting device may be a microphone array including a plurality of microphones.

The processor 30 processes the input audio signal received by the receiving unit 10. In detail, the processor 30 may include a format converter, a renderer, and a post-processing unit. The format converter converts a format of the input audio signal into another format. In detail, the format converter may convert an object signal into an ambisonic signal. Here, the ambisonic signal may be a signal recorded through a microphone array. Furthermore, the ambisonic signal may be a signal obtained by converting a signal recorded through a microphone array into a coefficient for a base of spherical harmonics. Furthermore, the format converter may convert the ambisonic signal into the object signal. In detail, the format converter may change an order of the ambisonic signal. For example, the format converter may convert a higher order ambisonics (HoA) signal into a first order ambisonics (FoA) signal. Furthermore, the format converter may obtain location information related to the input audio signal, and may convert the format of the input audio signal based on the obtained location information. Here, the location information may be information about a microphone array which has collected a sound corresponding to an audio signal. In detail, the information on the microphone array may include at least one of arrangement information, number information, location information, frequency characteristic information, or beam pattern information of microphones constituting the microphone array. Furthermore, the location information related to the input audio signal may include information indicating a location of a sound source.

The renderer renders the input audio signal. In detail, the renderer may render a format-converted input audio signal. Here, the input audio signal may include at least one of a loudspeaker channel signal, an object signal, or an ambisonic signal. In a specific embodiment, the renderer may render, by using information indicated by an audio signal format, the input audio signal into an audio signal that enables the input audio signal to be represented by a virtual sound object located in a three-dimensional space. For example, the renderer may render the input audio signal in association with a plurality of speakers. Furthermore, the renderer may binaurally render the input audio signal.

The output unit 70 outputs a rendered audio signal. In detail, the output unit 70 may output an audio signal through at least two loudspeakers. In another specific embodiment, the output unit 70 may output an audio signal through a 2-channel stereo headphone.

The audio signal processing device may concurrently process an ambisonic signal and an object signal. Specific operation of the audio signal processing device will be described with reference to FIG. 2.

Figure 2:
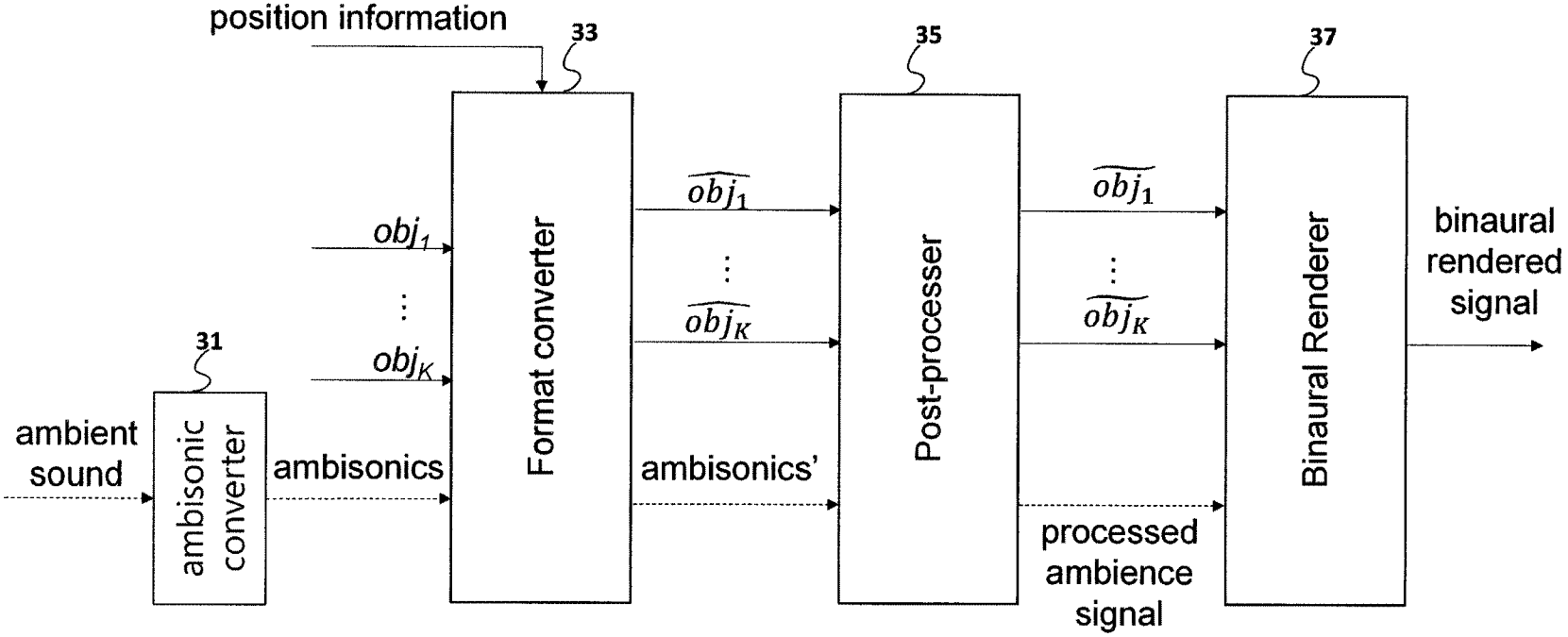
FIG. 2 is a block diagram illustrating that the audio signal processing device according to an embodiment of the present invention concurrently processes an ambisonic signal and an object signal.

FIG. 2 is a block diagram illustrating that the audio signal processing device according to an embodiment of the present invention concurrently processes an ambisonic signal and an object signal.

The above-mentioned ambisonics is one of methods for enabling the audio signal processing device to obtain information on a sound field and reproduce a sound by using the obtained information. In detail, the ambisonics may represent that the audio signal processing device processes an audio signal as below.

For ideal processing of an ambisonic signal, the audio signal processing device is required to obtain information on a sound source from sounds from all directions which are incident to one point in a space. However, since there is a limit in reducing a size of a microphone, the audio signal processing device may obtain the information on the sound source by calculating a signal incident to an infinitely small dot from a sound collected from a spherical surface, and may use the obtained information. In detail, in a spherical coordinate system, a location of each microphone of the microphone array may be represented by a distance from a center of the coordinate system, an azimuth (or horizontal angle), and an elevation angle (or vertical angle). The audio signal processing device may obtain a base of spherical harmonics using a coordinate value of each microphone in the spherical coordinate system. Here, the audio signal processing device may project a microphone array signal into a spherical harmonics domain based on each base of spherical harmonics.

For example, the microphone array signal may be recorded through a spherical microphone array. When the center of the spherical coordinate system is matched to a center of the microphone array, a distance from the center of the microphone array to each microphone is constant. Therefore, the location of each microphone may be represented by an azimuth θ and an elevation angle ϕ. Provided that the location of qth microphone of the microphone array is $(\theta_q, \phi_q)$ a signal $p_a$ recorded through the microphone may be represented as the following equation in the spherical harmonics domain.

$$p_a(\theta_q, \phi_q) = \sum_{m=0}^{\infty} \sum_{n=-m}^{m} B^{nm} Y^{nm}(\theta_q, \phi_q) \quad \text{[Equation 1]}$$

$p_a$ denotes a signal recorded through a microphone. $(\theta_q, \phi_q)$ denotes the azimuth and the elevation angle of the qth microphone. Y denotes spherical harmonics having an azimuth and an elevation angle as factors. m denotes an order of the spherical harmonics, and n denotes a degree. B denotes an ambisonic coefficient corresponding to the spherical harmonics. In the present disclosure, the ambisonic coefficient may be referred to as an ambisonic signal. In detail, the ambisonic signal may represent either an FoA signal or an HoA signal.

Here, the audio signal processing device may obtain the ambisonic signal using a pseudo inverse matrix of spherical harmonics. In detail, the audio signal processing device may obtain the ambisonic signal using the following equation.

$$p_a = YB$$

$$\Leftrightarrow B = p\mathrm{inv}(Y)p_a \quad \text{[Equation 2]}$$

As described above, $p_a$ denotes a signal recorded through a microphone, and B denotes an ambisonic coefficient corresponding to spherical harmonics. pinv(Y) denotes a pseudo inverse matrix of Y.

The above-mentioned object signal represents an audio signal corresponding to a single sound object. In detail, the object signal may be a signal obtained by a sound collecting device near a specific sound object. Unlike an ambisonic signal that represents, in a space, all sounds collectable at a specific point, the object signal is used to represent that a sound output from a certain single sound object is delivered to a specific point. The audio signal processing device may represent the object signal in a format of an ambisonic signal using a location of a sound object corresponding to the object signal. Here, the audio signal processing device may measure the location of the sound object using an external sensor installed in a microphone which collects a sound corresponding to the sound object and an external sensor installed on a reference point for location measurement. In another specific embodiment, the audio signal processing device may analyze an audio signal collected by a microphone to estimate the location of the sound object by. In detail, the audio signal processing device may represent the object signal as an ambisonic signal using the following equation.

$$B_{nm}^{S} = SY(\theta_S, \phi_S) \quad \text{[Equation 3]}$$

θs and ϕs respectively denote an azimuth and an elevation angle representing the location of a sound object corresponding to an object. Y denotes spherical harmonics having an azimuth and an elevation angle as factors. $B^S$nm denotes an ambisonic signal converted from an object signal.

Therefore, when the audio signal processing device simultaneously process an object signal and an ambisonic signal, the audio signal processing device may use at least one of the following methods. In detail, the audio signal processing device may separately output the object signal and the ambisonic signal. Furthermore, the audio signal processing device may convert the object signal into an ambisonic signal format to output the ambisonic signal and the object signal converted into the ambisonic signal format. Here, the ambisonic signal and the object signal converted into the ambisonic signal format may be HoA signals. Alternatively, the ambisonic signal and the object signal converted into the ambisonic signal format may be FoA signals. In another specific embodiment, the audio signal processing device may output only the ambisonic signal without the object signal. Here, the ambisonic signal may be FoA signals. Since it is assumed that the ambisonic signal includes all sounds collected from one point in a space, it may be assumed that the ambisonic signal includes signal components corresponding to the object signal. Therefore, the audio signal processing device may reproduce a sound object corresponding to the object signal by processing only the ambisonic signal without separately processing the object signal in the manner of the above-mentioned embodiment.

In a specific embodiment, the audio signal processing device may process the ambisonic signal and the object signal in the manner of the embodiment of FIG. 2. An ambisonic converter 31 converts an ambient sound into the ambisonic signal. A format converter 33 changes the formats of the object signal and the ambisonic signal. Here, the format converter 33 may convert the object signal into the ambisonic signal format. In detail, the format converter 33 may convert the object signal into HoA signals. Furthermore, the format converter 33 may convert the object signal into FoA signals. Furthermore, the format converter 33 may convert an HoA signal into an FoA signal. A post-processor 35 post-processes a format-converted audio signal. A binaural renderer 37 binaurally renders a post-processed audio signal.

Figure 3:
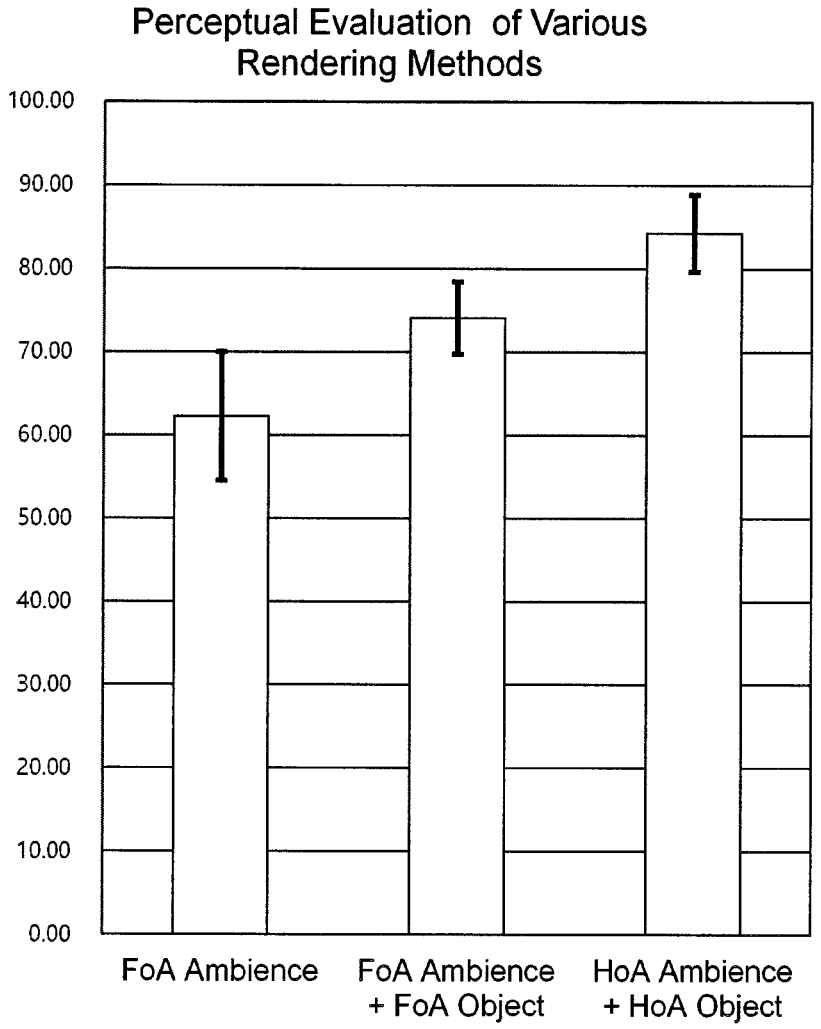
FIG. 3 illustrates a result of cognitive assessment of a quality of a sound output according to a method of processing an object signal and an ambisonic signal by the audio signal processing device according to an embodiment of the present invention.

FIG. 3 illustrates a result of cognitive assessment (with 95% confidence interval) of a quality of a sound output according to a method of processing an object signal and an ambisonic signal by the audio signal processing device according to an embodiment of the present invention.

As described above, the audio signal processing device may convert an HoA signal into an FoA signal. In detail, the audio signal processing device may remove higher-order components other than zeroth-order and first-order components from the HoA signal to convert the HoA signal into the FoA signal. The higher the order of spherical harmonics used when generating an ambisonic signal, the higher the spatial resolution expressible by an audio signal. Therefore, when the audio signal is converted from an HoA signal to an FoA signal, the spatial resolution of the audio signal decreases. As a result, as illustrated in FIG. 3, when the audio signal processing device separately outputs an HoA signal and an object signal, an output sound is assessed as having a highest sound quality. Furthermore, when the audio signal processing device converts the object signal into an HoA signal and concurrently outputs an HoA signal and the object signal converted into an HoA signal, the output sound is assessed as having a next highest sound quality. When the audio signal processing device converts the object signal into an FoA signal and concurrently outputs an FoA signal and the object signal converted into an FoA signal, the output sound is assessed as having a next highest sound quality. When the audio signal processing device outputs only an FoA signal without a signal based on the object signal, the output sound is assessed as having a lowest sound quality.

Figure 4:
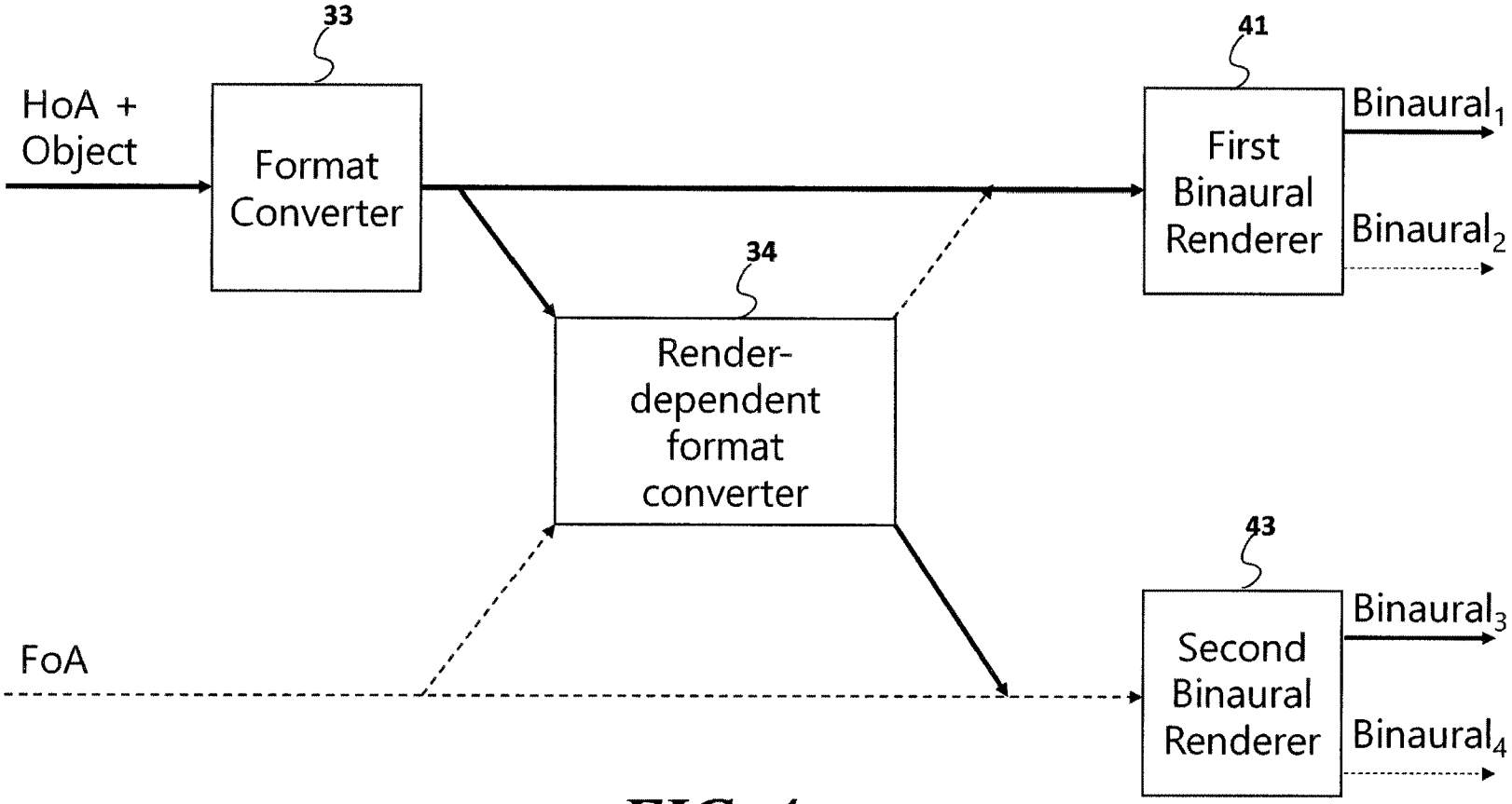
FIG. 4 illustrates a method of processing an audio signal according to the type of a renderer by the audio signal processing device according to an embodiment of the present invention.

FIG. 4 illustrates a method of processing, by the audio signal processing device according to an embodiment of the present invention, an audio signal according to a renderer which outputs an audio signal through a 2-channel stereo headphone.

The audio signal processing device according to an embodiment of the present invention may change the format of an input audio signal according to an audio signal format supported by a renderer. In detail, the audio signal processing device according to an embodiment of the present invention may use a plurality of renderers. Here, the audio signal processing device may change the format of an input audio signal according to audio signal formats supported by the renderers. In detail, when the renderers only support rendering of an FoA signal, the audio signal processing device may change an object signal or an HoA signal into an FoA signal. FIG. 4 illustrates a specific operation of the audio signal processing device for changing the format of an input audio signal according to a renderer.

In the embodiment of FIG. 4, a first binaural renderer 41 supports rendering of an object signal and an HoA signal. A second binaural renderer 43 supports rendering of an FoA signal. In FIG. 4, dotted lines represent an audio signal based on an FoA signal, and solid lines represent an audio signal based on an HoA signal. Here, a renderer-dependent format converter 34 changes the format of an input audio signal according to which one of the first binaural renderer 41 and the second binaural renderer 43 is used. In detail, when the audio signal processing device uses the first binaural renderer 41, the renderer-dependent format converter 34 converts an FoA signal into an HoA signal or an object signal. When the audio signal processing device uses the second binaural renderer 43, the renderer-dependent format converter 34 converts an object signal or an HoA signal into an FoA signal.

As described above, the audio signal processing device may process audio signals collected by different sound collecting devices. A plurality of sound collecting devices may be used in one space to collect a stereophonic sound. Here, one sound collecting device may be used to collect an ambient sound, and another sound collecting device may be used to collect a sound output from a specific sound object. In particular, the sound collecting device used to collect a sound output from a specific sound object may be attached to a sound object to minimize an influence of the location or direction of a sound object or a spatial structure.

The audio signal processing device may render a plurality of sounds collected for different roles at different locations, according to characteristics of the sounds. For example, the audio signal processing device may use an ambient sound to represent a spatial characteristic. Here, the audio signal processing device may use a sound output from a specific sound object to represent that the specific sound object is positioned at a specific point in a three-dimensional space. In detail, the audio signal processing device may represent the sound object by adjusting a relative location of the sound output from the sound object based on a location of a user. Here, the audio signal processing device may output an ambient sound regardless of the location of the user.

Since an ambient sound and a sound output from a sound object are collected in the same space, the sound output from the sound object may be collected through a microphone used to collect the ambient sound. Furthermore, the ambient sound may be collected through a microphone used to collect the sound of the sound object. Using this characteristic, the audio signal processing device may process sounds having different characteristics. This operation will be described with reference to FIGS. 5 to 7.

Figure 5:
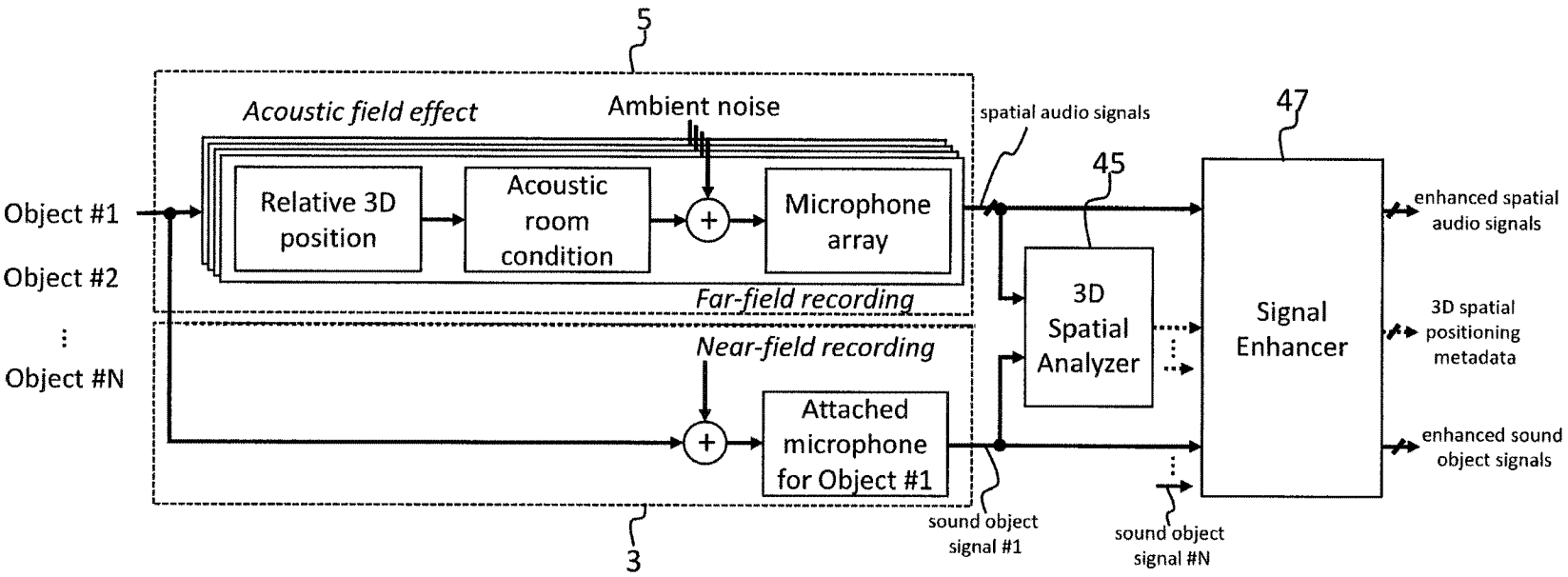
FIG. 5 illustrates a method of processing, by the audio signal processing device according to an embodiment of the present invention, a spatial audio signal and an object signal based on a relationship therebetween.

FIG. 5 illustrates a method of processing, by the audio signal processing device according to an embodiment of the present invention, a spatial audio signal and an object signal based on a relationship therebetween.

The audio signal processing device may process at least one of a first audio signal or a second audio signal based on a correlation between the first audio signal corresponding to a sound collected by a first sound collecting device and the second audio signal corresponding to a sound collected by a second sound collecting device. Here, the first sound collecting device may be positioned closer to a specific sound object than the second sound collecting device. In detail, the first audio signal is a signal for reproducing an output sound of the specific sound object, and the second audio signal is a signal for ambience reproduction of a space in which the specific sound object is positioned. In a specific embodiment, the first sound collecting device may be positioned within a shorter distance than a distance corresponding to wavelength of a reference frequency from the specific sound object. Here, the first sound collecting device may collect a dry sound without a reverberation from the specific sound object. Furthermore, the first sound collecting device may be used to obtain an object signal corresponding to the sound output from the specific sound object. The first audio signal may be a mono or stereo audio signal. The second sound collecting device may be used to collect an ambient sound. The second sound collecting device may collect a sound through a plurality of microphones. The audio signal processing device may convert the second audio signal into an ambisonic signal.

The second sound collecting device may assume that a direct sound of a sound object is simultaneously delivered to a plurality of microphones in the case where the second sound collecting device is a sound collecting device for obtaining an ambisonic signal, even though the second sound collecting device collects a sound through the plurality of microphones. This is because it may be assumed that a sound collecting device for collecting ambience collects sounds from all directions which are incident to one point in a space. When the second sound collecting device is spaced at least a certain distance apart from the sound object, the second sound collecting device receives fewer sounds from the sound object. Therefore, it may be assumed that an energy magnitude of an ambient sound collected by the second sound collecting device is not changed according to a distance between the second sound collecting device and the sound object. As a result, a most important factor that determines the correlation between the first audio signal and the second audio signal may be a parameter related to the location of the sound object, such as the direction of the sound object, the distance between the sound object and the second sound collecting device, or the like. Provided that the second sound collecting device is positioned at an origin, and the sound object is positioned close to an x-axis, the audio signal processing device may obtain, as a higher value, the correlation between the first audio signal and the second audio signal with respect to the x-axis than a value of the correlation between the first audio signal and the second audio signal with respect to another axis. Therefore, the audio signal processing device may obtain a parameter related to the location of the sound object which outputs a sound collected by the first sound collecting device, based on the correlation between the first audio signal and the second audio signal. Here, the parameter related to the location of the sound object may include at least one of coordinates of the sound object, the direction of the sound object, or the distance between the sound object and the second sound collecting device.

In detail, the audio signal processing device may obtain the parameter related to the location of the sound object collected by the first sound collecting device, based on the correlation between the first audio signal and the second audio signal and a time difference between the first audio signal and the second audio signal. The audio signal processing device may obtain the parameter related to the location of the sound object which outputs a sound collected by the first sound collecting device, by using the following equation.

$$\phi_m[d] = \frac{\sum_{n=0}^{N-1} s[n]c_m[n-d]}{\sqrt{\left(\sum_{n=0}^{N-1} s^2[n]\right)\left(\sum_{n=0}^{N-1} c_m^2[n]\right)}} \text{ for } m \in (x, y, z) \quad \text{[Equation 4]}$$

m denotes a coordinate axis indicating a base direction in a space. According to a spatial resolution, m may indicate x, y, and z directions or more directions. $\phi_m$ denotes the cross-correlation between a first signal and a second signal with respect to an axis indicated by m. s denotes a first audio signal, and $c_m$ denotes an ambisonic signal obtained by projecting a second audio signal with spatial x, y, and z axes as base directions. d denotes a parameter indicating a time delay. Here, a value of the time delay may be determined based on the parameter related to the location of a sound object. In detail, the value of the time delay may be determined based on the distance between the first sound collecting device and the second sound collecting device. The audio signal processing device may obtain the time difference between the first audio signal and the second audio signal by calculating a value of d which maximizes the cross-correlation of Equation 4. In detail, the audio signal processing device may obtain the time difference between the first audio signal and the second audio signal by using the following equation.

$$ITD_m = \underset{d}{\operatorname{argmax}}(\phi_m[d]) \text{ for } m \in (x, y, z) \quad \text{[Equation 5]}$$

$ITD_m$ denotes a time difference between a first audio signal and a second audio signal with respect to an axis indicated by m.

$$\underset{d}{\operatorname{argmax}}(x)$$

denotes d which maximizes x. As described above, $\phi_m$ denotes the cross-correlation between a first audio signal and a second audio signal with respect to an axis indicated by m.

The audio signal processing device may obtain coordinates of a sound object by using the correlation between the first audio signal and the second audio signal which corresponds to the time difference between the first audio signal and the second audio signal. In detail, the audio signal processing device may obtain the coordinates of the sound object by applying a variable constant for distance for each coordinate axis to the cross-correlation obtained using Equations 1 and 2. Here, the variable constant for distance may be determined based on a characteristic of a sound output from the sound object. In detail, the variable constant for distance may be determined based on a directivity characteristic (source directivity pattern) of a sound output from the sound object. Furthermore, the variable constant for distance may be determined based on a device characteristic of the second sound collecting device. In detail, the variable constant for distance may be determined based on a directivity pattern of the second sound collecting device. Furthermore, the variable constant for distance may be determined based on the distance between the sound object and the second sound collecting device. Moreover, the variable constant for distance may be determined based on a physical characteristic of a space (room) in which the second sound collecting device is located. The larger the variable constant for distance, the more sounds the second sound collecting device collects in a direction of a coordinate axis to which the variable constant is applied. In detail, the audio signal processing device may obtain the coordinates of the sound object using the following equation.

$$[x_s \quad y_s \quad z_s]^T = [\phi_x[ITD_x] \quad \phi_y[ITD_y] \quad \phi_z[ITD_z]] \begin{bmatrix} w_x & 0 & 0 \\ 0 & w_y & 0 \\ 0 & 0 & w_z \end{bmatrix} \quad \text{[Equation 6]}$$

$x_s$, $y_s$, and $z_s$ respectively denote x, y, and z coordinate values of the sound object. $w_m$ denotes a variable constant value for distance applied to a coordinate axis corresponding to m. $\phi_m[ITD_m]$ denotes the correlation between a first audio signal and a second audio signal on a coordinate axis corresponding to m.

The audio signal processing device may convert the x, y, and z coordinates of the sound object into coordinates of a spherical coordinate system. In detail, the audio signal processing device may obtain an azimuth and an elevation angle using the following equations.

$$\theta = \arctan\left(\frac{y_s}{x_s}\right) \quad \text{[Equation 7]}$$

$$\varphi = \arccos\left(\frac{z_s}{\sqrt{x_s^2 + y_s^2 + z_s^2}}\right) \quad \text{[Equation 8]}$$

θ denotes an azimuth, and φ denotes an elevation angle. As described above, $x_s$, $y_s$, and $z_s$ respectively denote the x, y, and z coordinate values of the sound object.

The audio signal processing device may obtain the parameter related to the location of the sound object, and may generate, based on the obtained parameter, metadata indicating the location of the sound object.

FIG. 5 illustrates a procedure in which the audio signal processing device obtains the parameter related to the location of the sound object based on the correlation between a first audio signal and a second audio signal in a specific embodiment. In the example of FIG. 5, a first collecting device 3 outputs first audio signals (sound object signal #1, . . . , sound object signal #n). A second collecting device 5 outputs second audio signals (spatial audio signals). Here, the audio signal processing device receives the first audio signals (sound object signal #1, . . . , sound object signal #n) and the second audio signals (spatial audio signals) through an input unit (not shown). The above-mentioned processor includes a 3D spatial analyzer 45 and a signal enhancer 47. The 3D spatial analyzer 45 obtains the parameter related to the location of the sound object based on the correlation between the first audio signals (sound object signal #1, . . . , sound object signal #n) and the second audio signals (spatial audio signals). The signal enhancer 47 outputs the metadata indicating the location of the sound object based on the parameter related to the location of the sound object. This operation will be described with reference to FIG. 6.

Figure 6:
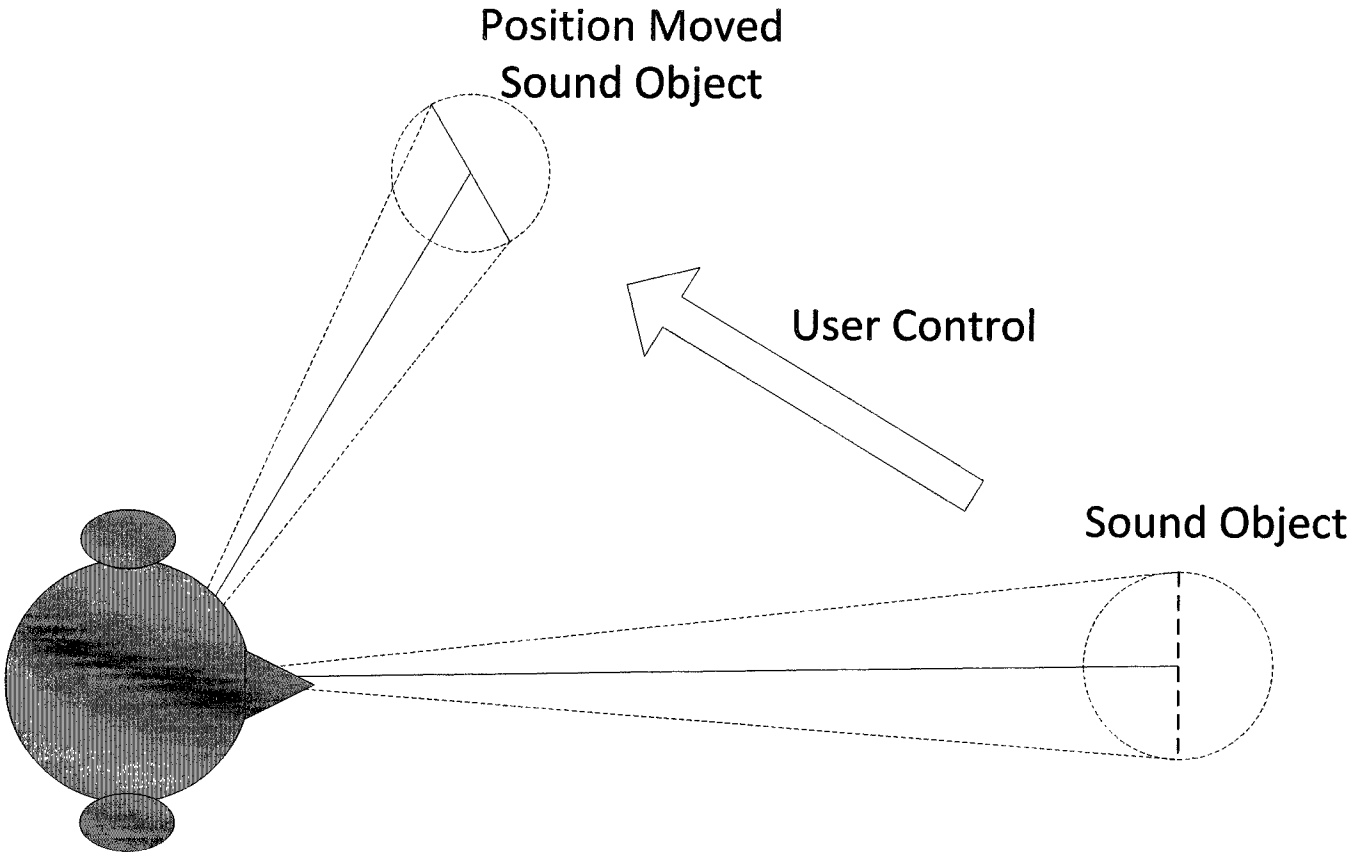
FIG. 6 illustrates that the audio signal processing device according to an embodiment of the present invention adjusts the location of a sound object according to a user's input.

FIG. 6 illustrates that the audio signal processing device according to an embodiment of the present invention adjusts the location of a sound object according to a user's input.

As described above with reference to FIG. 5, the audio signal processing device may obtain the parameter related to the location of the sound object based on the correlation between a first audio signal and a second audio signal. Here, the audio signal processing device may represent that the sound object is positioned at a specific location by using the obtained parameter related to the location of the sound object. In detail, the audio signal processing device may adjust the parameter related to the location of the sound object, and may render the first audio signal based on the adjusted parameter. Furthermore, the audio signal processing device may adjust the parameter related to the location of the sound object, and may generate metadata indicating the adjusted parameter. In detail, the audio signal processing device may determine a location in which the sound object is to be localized in a three-dimensional space according to a user's input, and may adjust the parameter related to the location of the sound object according to a determined location. Here, the user's input may include a signal tracking a motion of the user. In detail, the signal tracking the motion of the user may include a head tracking signal.

Referring back to FIG. 5, the audio signal processing device according to an embodiment of the present invention will be described. The signal enhancer 47 may enhance at least one of the first audio signals (sound object signal #1, . . . , sound object signal #n) or the second audio signals (spatial audio signals) based on the parameter related to the location of the sound object. In detail, the signal enhancer 47 may be operated according to the following embodiments.

The first audio signal may be a signal for reproducing a sound output from a sound object, and the second audio signal may be a signal for reproducing an ambience sound. Here, an audio signal component corresponding to the ambience sound may be included in the first audio signal, or an audio signal component corresponding to the sound output from the sound object may be included in the second audio signal. Accordingly, three-dimensionality represented by the first audio signal and the second audio signal may deteriorate. Therefore, influences between a sound to be represented using the first audio signal and a sound to be represented using the second audio signal are required to be reduced in a sound collected by the first sound collecting device and a sound collected by the second sound collecting device.

The audio signal processing device may process the second audio signal by subtracting an audio signal generated based on the first audio signal from the second audio signal. The audio signal generated based on the first audio signal may be a signal generated based on an audio signal obtained by applying a time delay to the first audio signal. Here, a value of the time delay may be the time difference between the first audio signal and the second audio signal. Furthermore, the audio signal generated based on the first audio signal may be a signal obtained by scaling an audio signal obtained by applying the time delay to the first audio signal. Here, a scaling value may be determined based on a level difference between the first audio signal and the second audio signal. In detail, the audio signal processing device may process the second audio signal using the following equation.

$$c_m^{new}[n] = c_m[n] - \alpha_m s[n-d] \text{ for } d = ITD_m \text{ and } \alpha_m = \sqrt{1/10^{0.1 \cdot ILD_m}} \quad \text{[Equation 9]}$$

$c_m^{new}$ denotes a signal obtained by subtracting an audio signal generated based on the first audio signal from the second audio signal. Therefore, $c_m^{new}$ may denote an audio signal generated to minimize a sound component of a sound object included in the second audio signal. d denotes a parameter indicating a time delay. The time difference between the first audio signal and the second audio signal may be applied to d. $\alpha_m$ denotes a scaling variable. $ILD_m$ denotes the level difference between the first audio signal and the second audio signal. The audio signal processing device may calculate the level difference between the first audio signal and the second audio signal by using the following equation.

$$ILD_m = 10\log_{10}\frac{\sum_{n=0}^{N-1} c_m^2[n]}{\sum_{n=0}^{N-1} s^2[n]} \text{ for } m = [x, y, z] \quad \text{[Equation 10]}$$

$ILD_m$ denotes the level difference between the first audio signal and the second audio signal with respect to an axis indicated by m. As described above, s denotes the first audio signal, and $c_m$ denotes the second audio signal.

The audio signal processing device may process the second audio signal by subtracting an audio signal generated based on the second audio signal from the first audio signal. Here, the audio signal generated based on the second audio signal may be a signal obtained by subtracting an audio signal generated based on the first audio signal from the second audio signal. For convenience, the audio signal obtained by subtracting the audio signal generated based on the first audio signal from the second audio signal is referred to as a third audio signal. The audio signal generated based on the second audio signal may be obtained by averaging the third audio signal. In detail, the audio signal processing device may process the first audio signal using the following equation.

$$s^{new}[n] = s[n] - \frac{1}{M}\sum_{m\in(x,y,z)} c_m^{new}[n] \quad \text{[Equation 11]}$$

$s^{new}[n]$ denotes a signal obtained by subtracting an audio signal generated based on the second audio signal from the first audio signal. Therefore, $s^{new}[n]$ may denote an audio signal generated to minimize a sound component corresponding to an ambience sound from the first audio signal. s[n] denotes the first audio signal. $c_m^{new}$ denotes the third audio signal described above in relation to Equation 9 and obtained by subtracting the audio signal generated based on the first audio signal from the second audio signal. M denotes the number of axes in a space used in the embodiments described above in relation to Equations 9 and 11.

When a sound object does not output a sound, the audio signal processing device may determine that a sound collected by the first sound collecting device corresponds to a stationary noise. However, since a characteristic of a non-stationary noise changes as time passes, the audio signal processing device is unable to determine which sound corresponds to a non-stationary noise based on only a sound collected by the first sound collecting device. In the case where the audio signal processing device uses the above-mentioned embodiments related to processing of the first audio signal and the second audio signal, the audio signal processing device may remove not only the stationary noise but also the non-stationary noise from the first audio signal.

In another specific embodiment, the audio signal processing device may enhance a portion of components in the second audio signal based on the correlation between the first audio signal and the second audio signal. In detail, the audio signal processing device may increase a gain of the portion of components in the second audio signal based on the correlation between the first audio signal and the second audio signal. In a specific embodiment, the audio signal processing device may enhance a signal component of the second audio signal which has a higher value of correlation with the first audio signal than a certain reference value. Here, the audio signal processing device may output only the second audio signal of which the signal component having a high correlation with the first audio signal is enhanced, without outputting the first audio signal. Furthermore, the audio signal processing device may output, in an ambisonic signal format, the second audio signal of which the signal component having a high correlation with the first audio signal is enhanced.

Figure 7:
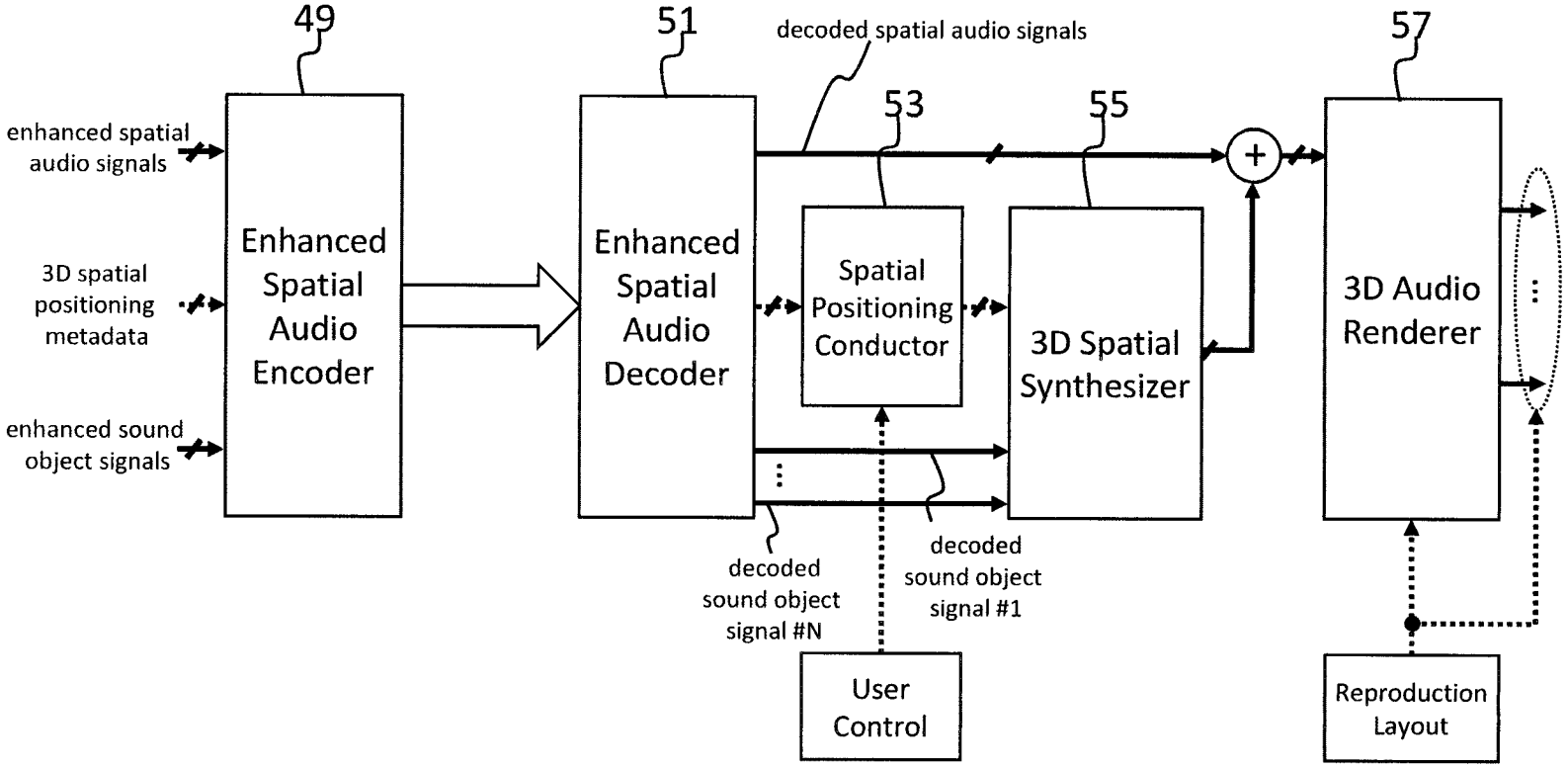
FIG. 7 illustrates that the audio signal processing device according to an embodiment of the present invention renders an audio signal according to a reproduction layout.

FIG. 7 illustrates that the audio signal processing device according to an embodiment of the present invention renders an audio signal according to a reproduction layout.

The audio signal processing device may render an audio signal according to the reproduction layout based on the parameter related to the location of a sound object. Here, the reproduction layout may represent a speaker arrangement layout for outputting an audio signal. In detail, the audio signal processing device may render an audio signal according to the reproduction layout based on the metadata indicating the location of the sound object. The audio signal processing device may obtain the parameter related to the location of the object through the embodiments described above with reference to FIGS. 5 and 6. Furthermore, the audio signal processing device may generate the metadata indicating the location of the sound object through the embodiments described above with reference to FIGS. 5 and 6.

In the embodiment of FIG. 7, an enhanced spatial audio encoder 49 encodes metadata of enhanced first audio signals (enhanced sound object signals) and enhanced second audio signal (enhanced spatial audio signals) into a bitstream. An enhanced spatial audio decoder 51 decodes the bitstream. Here, a spatial positioning conductor 53 may adjust the location of the sound object according to a user's input. A 3D spatial synthesizer 55 synthesizes an audio signal corresponding to a location-adjusted sound object with another audio signal included in the bitstream. A 3D audio renderer 57 renders an audio signal by localizing the sound object in a three-dimensional space according to the parameter related to the location of the sound object. Here, the 3D audio renderer 57 may render the audio signal according to the reproduction layout.

According to these embodiments, the audio signal processing device may give a sense of reality so that the sound object is felt as if the sound object were positioned at a specific point in a three-dimensional space. In particular, the audio signal processing device may give a sense of reality so that the sound object is felt as if the sound object were positioned at a specific point in a three-dimensional space even if a reproduction environment is changed.

Figure 8:
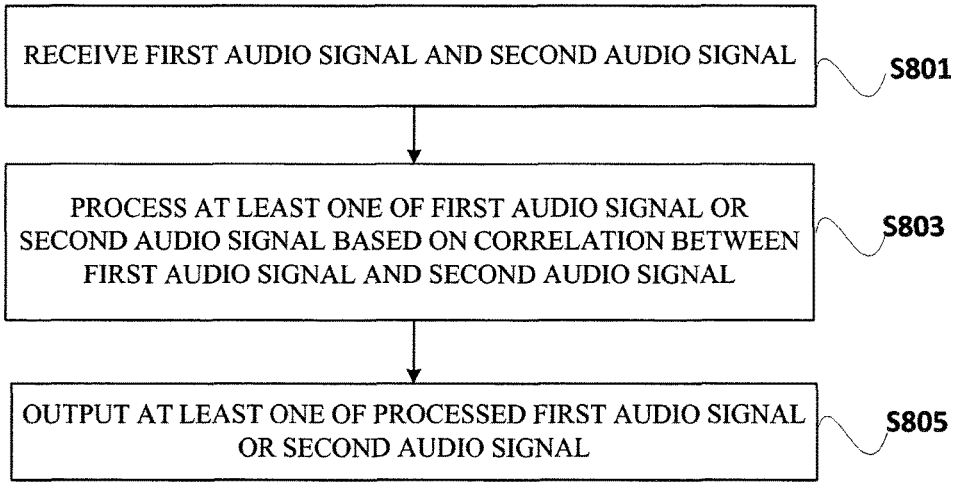
FIG. 8 illustrates operation of the audio signal processing device according to an embodiment of the present invention.

FIG. 8 is a flowchart illustrating operation of the audio signal processing device according to an embodiment of the present invention.

The audio signal processing device receives a first audio signal and a second audio signal (S801). Here, the first audio signal may correspond to a sound collected by a first sound collecting device, and the second audio signal may correspond to a sound collected by a second sound collecting device. The first audio signal may be a signal for reproducing an output sound of a specific sound object, and the second audio signal may be a signal for ambience reproduction of a space in which the specific sound object is positioned. In detail, the first sound collecting device may be positioned closer to the specific sound object than the second sound collecting device. In detail, the first sound collecting device may be positioned within a shorter distance than a distance corresponding to wavelength of a reference frequency from the specific sound object. Here, the first sound collecting device may collect, from the specific sound object, a dry sound without a reverberation or a dry sound having a less reverberation than that of the second audio signal collected by the second sound collecting device. Furthermore, the first sound collecting device may be used to obtain an object signal corresponding to the specific sound object. The second sound collecting device may be used to collect an ambisonic signal. The second sound collecting device may collect a sound through a plurality of microphones. The audio signal processing device may convert the second audio signal into an ambisonic signal. Accordingly, the second audio signal may be converted into an ambisonic signal format. The first audio signal may be converted into a mono or stereo audio signal format corresponding to the sound object.

The audio signal processing device processes at least one of the first audio signal or the second audio signal based on the correlation between the first audio signal and the second audio signal (S803). In detail, the audio signal processing device may subtract an audio signal generated based on the first audio signal from the second audio signal. Here, the audio signal generated based on the first audio signal may be a signal generated based on an audio signal obtained by applying a time delay to the first audio signal. In detail, the audio signal generated based on the first audio signal may be a signal obtained by delaying the first audio signal by as much as the time difference between the first audio signal and the second audio signal. Furthermore, the audio signal generated based on the first audio signal may be a signal obtained by scaling, based on the level difference between the first audio signal and the second audio signal, the audio signal obtained by applying the time delay to the first audio signal. In detail, the audio signal processing device may process the second audio signal as described above in relation to Equations 9 and 10.

The audio signal processing device may process the first audio signal by subtracting an audio signal generated based on the second audio signal from the first audio signal. Here, the audio signal processing device outputs a processed first audio signal and a processed second audio signal. In detail, the audio signal processing device may process the first audio signal as described above in relation to Equation 11.

The audio signal processing device may enhance a portion of components in the second audio signal based on the correlation between the first audio signal and the second audio signal. In detail, the audio signal processing device may enhance a signal component of the second audio signal which has a higher value of correlation with the first audio signal than a certain reference value. Here, the audio signal processing device may output the second audio signal of which the signal component having a high correlation with the first audio signal is enhanced, without outputting the first audio signal. Furthermore, the audio signal processing device may output, in an ambisonic signal format, the second audio signal of which the signal component having a high correlation with the first audio signal is enhanced.

The audio signal processing device may obtain the parameter related to the location of the specific sound object based on the correlation between the first audio signal and the second audio signal. Here, the audio signal processing device may render the first audio signal by localizing the specific sound object in a three-dimensional space based on the parameter related to the location of the specific sound object. The audio signal processing device may obtain the parameter related to the location of the specific sound object based on the correlation between the first audio signal and the second audio signal and the time difference between the first audio signal and the second audio signal. The audio signal processing device may obtain the parameter related to the location of the specific sound object based on the correlation between the first audio signal and the second audio signal, the time difference between the first audio signal and the second audio signal, and the variable constant for distance applied for each coordinate axis. Here, the variable constant for distance may be determined based on a characteristic of a sound output from the specific sound object. In detail, the variable constant for distance may be determined based on a directivity characteristic of the sound output from the specific sound object. Furthermore, the variable constant for distance may be determined based on a device characteristic of the second sound collecting device. In detail, the variable constant for distance may be determined based on a radiation pattern of the second sound collecting device. Furthermore, the variable constant for distance may be determined based on the distance between the specific sound object and the second sound collecting device. Moreover, the variable constant for distance may be determined based on a physical characteristic of a space (room) in which the second sound collecting device is located. In detail, the audio signal processing device may obtain the parameter related to the location of the specific sound object as described above in relation to Equations 4 to 6.

The audio signal processing device may determine a location in which the specific sound object is to be localized in a three-dimensional space according to a user's input, and may adjust the parameter related to the location of the specific sound object according to a determined location. In detail, the audio signal processing device may render the first audio signal as described above with reference to FIGS. 6 and 7.

The audio signal processing device outputs at least one of a processed first audio signal or a processed second audio signal (S805). The audio signal processing device may output the first audio signal in an object signal format, and may output the second audio signal in an ambisonic signal format. Here, the object signal format may be a mono signal format or a stereo signal format. The audio signal processing device may output the first audio signal in the ambisonic signal format, and may output the second audio signal in the ambisonic signal format based on the parameter related to the location of the specific sound object. Here, the audio signal processing device may convert the first audio signal into the ambisonic signal format based on the parameter related to the location of the specific sound object. The audio signal processing device may convert the first audio signal into the ambisonic signal format using the embodiments described above in relation to Equation 3. In a specific embodiment, the audio signal processing device may output the first audio signal and the second audio signal according to the embodiments described above with reference to FIGS. 2 to 4.

Embodiments of the present invention provide an audio signal processing method and device for processing a plurality of audio signals.

More specifically, embodiments of the present invention provide an audio signal processing method and device for processing an audio signal expressible as an ambisonic signal.

Although the present invention has been described using the specific embodiments, those skilled in the art could make changes and modifications without departing from the spirit and the scope of the present invention. That is, although the embodiments for processing multi-audio signals have been described, the present invention can be equally applied and extended to various multimedia signals including not only audio signals but also video signals. Therefore, any derivatives that could be easily inferred by those skilled in the art from the detailed description and the embodiments of the present invention should be construed as falling within the scope of right of the present invention.

What is claimed is:

1. An audio signal processing device comprising:

a processor configured to receive a first audio signal corresponding to a first sound collected by a first sound collecting device and a second audio signal corresponding to a second sound collected by a second sound collecting device, obtain a location of a specific sound object based on a relationship between the first and second audio signals and a directivity pattern of the second sound collecting device, render the first audio signal by localizing the specific sound object in a three-dimensional space based on the location of the specific sound object, render the second audio signal, and output the rendered first and second audio signals, wherein the first sound collecting device collects an output sound of the specific sound object, and the second sound collecting device collects an ambient sound of a space in which the specific sound object is positioned, wherein a distance between the first sound collecting device and the sound object is less than a distance between the second sound collecting device and the sound object.

2. The audio signal processing device of claim 1, wherein the processor subtracts an audio signal generated based on the first audio signal from the second audio signal in order to render the second audio signal.

3. The audio signal processing device of claim 2, wherein the audio signal generated based on the first audio signal is generated based on an audio signal obtained by applying a time delay to the first audio signal.

4. The audio signal processing device of claim 3, wherein the audio signal generated based on the first audio signal is obtained by delaying the first audio signal by as much as a time difference between the first audio signal and the second audio signal.

5. The audio signal processing device of claim 3, wherein the audio signal generated based on the first audio signal is obtained by scaling, based on a level difference between the first audio signal and the second audio signal, the audio signal obtained by applying the time delay to the first audio signal.

6. The audio signal processing device of claim 2, wherein the processor subtracts an audio signal generated based on the second audio signal from the first audio signal in order to render the first audio signal.

7. The audio signal processing device of claim 6, wherein the processor obtains the location of the specific sound object based on a correlation between the first audio signal and the second audio signal and a time difference between the first audio signal and the second audio signal.

8. The audio signal processing device of claim 7, wherein the processor obtains the location of the specific sound object based on the correlation between the first audio signal and the second audio signal, the time difference between the first audio signal and the second audio signal, and a variable constant for distance applied for each coordinate axis, wherein the variable constant for distance is determined based on the directivity pattern of the second sound collecting device.

9. The audio signal processing device of claim 7, wherein the location of the specific sound object is obtained based on the correlation between the first audio signal and the second audio signal, the time difference between the first audio signal and the second audio signal, and a variable constant for distance applied for each coordinate axis, wherein the variable constant for distance is determined based on a physical characteristic of the space in which the second sound collecting device is positioned.

10. The audio signal processing device of claim 6, wherein the processor determines a location in which the specific sound object is to be localized in the three-dimensional space according to a user's input, and adjusts the location of the specific sound object according to a determined location.

11. The audio signal processing device of claim 6, wherein the processor outputs the first audio signal in an object signal format and outputs the second audio signal in an ambisonic signal format.

12. The audio signal processing device of claim 6, wherein the processor outputs the first audio signal in an ambisonic signal format and outputs the second audio signal in the ambisonic signal format based on the location of the specific sound object.

13. The audio signal processing device of claim 1, wherein the processor increases a gain of portion of components of the second audio signal based on the correlation between the first audio signal and the second audio signal.

14. A method for operating an audio signal processing device, the method comprising:

receiving a first audio signal corresponding to a first sound collected by a first sound collecting device and a second audio signal corresponding to a second sound collected by a second sound collecting device;

obtaining a location of a specific sound object based on a relationship between the first and second audio signals and directivity pattern of the second sound collecting device;

rendering the first audio signal by localizing the specific object in a three-dimensional space based on the location of the specific sound object;

rendering the second audio signal; and outputting the rendered first and second audio signals, wherein the first sound collecting device collects an output sound of the specific sound object, and the second sound collecting device collects an ambient sound of a space in which the specific sound object is positioned, wherein a distance between the first sound collecting device and the sound object is less than a distance between the second sound collecting device and the sound object.

15. The method of claim 14, wherein the rendering the second audio signal comprises subtracting an audio signal generated based on the first audio signal from the second audio signal.

16. The method of claim 15, wherein the audio signal generated based on the first audio signal is generated based on an audio signal obtained by applying a time delay to the first audio signal.

17. The method of claim 16, wherein the audio signal generated based on the first audio signal is obtained by delaying the first audio signal by as much as a time difference between the first audio signal and the second audio signal.

18. The method of claim 16, wherein the audio signal generated based on the first audio signal is obtained by scaling, based on a level difference between the first audio signal and the second audio signal, the audio signal obtained by applying the time delay to the first audio signal.

* * * * *